US009615993B2

(12) United States Patent
Wang et al.

(10) Patent No.: US 9,615,993 B2
(45) Date of Patent: Apr. 11, 2017

(54) MASSAGE CHAIR HAVING CURVED TRACK

(71) Applicant: NINGBO BEYOND ELECTRONIC TECHNOLOGY CO., LTD, Fenghua/Zhejiang (CN)

(72) Inventors: Haiming Wang, Fenghua/Zhejiang (CN); Qiankun Gu, Xiamen/Fujian (CN); Weifeng Li, Linxiang/Hunan (CN)

(73) Assignee: NINGBO COMFORT HEALTH EQUIPMENT CO., LTD. (CN)

( * ) Notice: Subject to any disclaimer, the term of this patent is extended or adjusted under 35 U.S.C. 154(b) by 323 days.

(21) Appl. No.: 14/317,482

(22) Filed: Jun. 27, 2014

(65) Prior Publication Data

US 2015/0297441 A1 Oct. 22, 2015

(30) Foreign Application Priority Data

Apr. 16, 2014 (CN) ..... 2014 1 0153648

(51) Int. Cl.
*A61H 15/00* (2006.01)

(52) U.S. Cl.
CPC . *A61H 15/0078* (2013.01); *A61H 2015/0014* (2013.01); *A61H 2201/1623* (2013.01)

(58) Field of Classification Search
CPC ..... A61H 15/0078; A61H 2201/1215; A61H 2201/1623; A61H 2015/0014; A61H 2201/1664; A61H 2201/1645; A61H 2201/1676; A61H 2201/5028; A61H 2201/5061; A61H 2201/0149; A47C 11/00; A47C 7/70
See application file for complete search history.

(56) References Cited

U.S. PATENT DOCUMENTS

| | | | | |
|---|---|---|---|---|
| 6,832,991 | B1 * | 12/2004 | Inada | A61H 39/04 601/100 |
| 6,974,186 | B1 * | 12/2005 | Chang | A47C 1/035 297/423.19 |
| 2014/0159454 | A1 * | 6/2014 | Furutani | A47C 1/035 297/341 |
| 2015/0157528 | A1 * | 6/2015 | Le | A61H 15/00 601/99 |

* cited by examiner

*Primary Examiner* — Quang D Thanh

(57) ABSTRACT

The present invention is a massage chair, having a main frame with specific curve, a chair back located by a chair seat with a rotation angle; wherein the main frame including back section, buttock section and leg section, the buttock section has an upward curve and the leg section has a downward curve, thus, massage provider can provide massage service to human thigh when the rotation angle is more than 110 degree; a seat supporter is restricted by a restriction supporter, then the rotation angle is smaller as a first rotation supporter rotates counter-clockwise and the main frame rotates clockwise, wherein the seat supporter is disposed within the chair seat, and the first rotation terminal is disposed under the main frame.

9 Claims, 19 Drawing Sheets

9

MASSAGE CHAIR HAVING CURVED TRACK

BACKGROUND OF THE INVENTION

Field of the Invention

The present invention is related to a massage chair having curved track, and providing massage to human back and buttock.

Description of Related Art

Modern life moves faster as more society interaction. Human has more pressure and taking high lipid food, plus less exercise, the circulatory system has poor circulation and even causes serious cardiovascular disease. Particularly, blood vessel is easily stuck with high lipid food, and further increasing rick to stroke, metabolic arthritis and myocardial infarction. Health condition is connected with decreasing quality of life, to maintain certain health, proper adjustment of life should be critical as society changing.

Generally, exercise is an efficient regulation to body health, for example, aerobic exercise or taijiquan. Exercise is able to achieve metabolism through perspiration. However, it's always hard to squeeze the time in busy life. Thus, massage is popular to people, for various partial of body, to improve circulation in terms of circulatory system as well as metabolism.

Massage therapy reduces sporting injury produced by over exercise or physical sport for athlete, or painful contractions produced by fixed posture. In addition to the athlete, normal people also occasionally fix a specific posture for a period in office work. This fixed posture might not require high force generated by muscle, after a period, however, muscle has contractions, and uncomfortable pain is fallowed with stuck blood. So that, proper massage is necessary to normal people.

Many massage devices have been developed for convenient massage service, including foot massage device, leg massage device and massage chair. Massage chair has the most complicated structure with the highest level design. Please refer to FIG. 1, which demonstrates a conventional massage chair. FIG. 1 shows a conventional massage chair, including a chair back P1 and a chair seat P2, wherein the chair back P1 and the chair seat P2 both have massage device respectively. The massage device can process massage service at fixed posture, or process massage service as moving through the chair back P1 and the chair seat P2; the massage device at the chair back P1 can provide massage service to human back, and the massage device at the chair seat P2 can provide massage service to human buttock, or any part between human back and buttock; furthermore, the conventional massage chair might has leg massage device P3, so the human body and leg can process massage service.

The chair back P1 has a frame structure, and the massage device is disposed in the frame structure. The massage device moves in the frame structure as providing massage service to human back. The frame structure has various application in current technology, for example, rotating the frame structure in the chair back P1, tilting the chair back P1, and increasing the body weight on the chair back P1 to alter massage effect on human back, also rotating the leg massage device P3 to alter massage effect on human leg.

Please refer to FIG. 2, which demonstrates an L-type curved track module for conventional massage chair. The L-type curved track module Q1 shown in FIG. 2 can be disposed in conventional massage chair. The L-type curved track module Q1 is formed by left track Q11 and right track Q12 bond with at least one back bending tube Q13, wherein the left track Q11 and right track Q12 are parallel; any mechanical massage device can be disposed between the left track Q11 and right track Q12, and move along the L-type curved track module Q1 from neck, human back, then through caudal to buttock and thigh. The L-type curved track module for conventional massage chair disclosed in FIG. 2 is used to provide massage service like shiatsu and kneading to human body including parts of back, human buttock and thigh. However, the L-type curved track module Q1 has fixed curve, man sitting on the conventional massage chair is forced stay at exactly curve posture to keep certain massage service.

The L-type curved track module of FIG. 2 provides certain massage service and effect, but man sitting on the conventional massage chair must stay at exactly curve posture during massage service. Human muscle is hardly receiving relax when fixed posture is necessary during massage service, so massage effect is hardly brought out with well quality, especially to the man who already stay at fixed posture in work for long period; human body has partially uncomfortable painful issue after suffering unbalance pressure load on muscle when fixed posture cause muscle strength out of limit; as description, it is clear the L-type curved track module in FIG. 2 has disadvantage.

Due to uncomfortable painful issue on human body need to be avoided during massage service with fixed posture, another conventional massage chair is also being designed. Please refer to a FIGS. 3A and 3B, which demonstrate another conventional massage chair. A conventional massage chair in FIG. 3A provides a leading track (13), having an upper pin shaft and a lower pin shaft, wherein the upper pin shaft connects to a pin hole of a frame, the lower pin shaft connects to an end of a bar, so the leading track (13) swings around a point in terms of pivot used to connect the frame and the leading track (13); as shown in FIG. 3A, the conventional massage chair has two status, and the posture of man sitting on chair also changes with status, so the uncomfortable painful issue produced by fixed posture can be reduced. In the status of FIG. 3A, massage chair only provides human back massage, human buttock has no massage service; in the status of FIG. 3B, man can lay on chair, human buttock might has massage service by massage device (14). According to the FIG. 3A and FIG. 3B, the massage chair cannot provide the massage service from human neck to human thigh as the L-type curved track module shown in FIG. 2, thus, it is clear the massage chair in FIG. 3A and FIG. 3B has disadvantage.

In addition, human body can feel relax when lying down, and massage chair tilts as frame structure rotating to provide the massage service. However, the massage chair needs certain space to accommodate frame structure rotating, and more rotating requests more space. It is always necessary to spare a space on the back of the massage chair to accommodate frame structure rotating. The space is an economic waste which should be saved to the modern city where each inch of apartment costs certain price.

Massage chair, for more specifically, has a seat portion for sitting, a back portion with massage device for supporting human back, a seat frame disposed in the seat portion, and a back frame disposed in the back portion and connecting to the seat frame. The back frame rotates by the seat frame, so the seat portion rotates by the back portion as human body sit on the massage chair lying down and relax. It requests a space to accommodate the back portion when back frame rotates, or the back portion is blocked by the wall. Thus, a space is between the wall and the massage chair for accommodating. The space is only used for accommodating but functionless. It is a waste for modern apartment with modest space.

Everyone has different necessities, physical conditions and work environments, so massage service need to adjust as different status, thus, it is clear the massage chair has improvement in many respect. In view of the aforementioned drawbacks of the conventional massage chair, the inventor of the present invention based on years of practice experience in the related industry to conduct extensive researches and experiments, and finally developed a massage chair in accordance with the present invention to overcome the drawbacks of the prior art.

SUMMARY OF THE INVENTION

Therefore, it is a primary objective of the invention to provide a massage chair, wherein the rotation angle can be adjusted, so human body is able to stretch and relax instead of fixed posture, also, human body has massage service from shoulder to buttock under any status; moreover, the leg section has a downward curve, thus, massage provider is able to provide massage service to human leg when rotation angle is greater than 110 degree.

It is another objective of the invention to provide a massage chair, wherein using mechanism principle to design mechanical structure makes reference point moving straight, so the massage chair can be located close to wall, and the space can be saved.

It is another objective of the invention to provide a massage chair, wherein the cylinder supporter connects to the seat supporter, and connects to the second electrical cylinder on the other end, so the foot massage device being lifted up is not driven by the second electrical cylinder but followed by the seat supporter moving up, and the human leg can be located in the foot massage device with the same bending angle.

To achieve the aforementioned objective, the present invention provides a massage chair having curved track, including: a main chair, supporting human body, having a chair back and a chair seat, wherein the chair back is located by the chair seat with a rotation angle, also being adjusted and rotating properly by the chair seat; wherein the chair back has a back massage surface, the chair seat has a seat massage surface; a main frame, being stiffness frame, and being located within the main chair;

wherein, the main frame has two internal slide tracks, and further comprises: a back section, being located and fixed in the chair back, and having a massage distance from the back massage surface; a buttock section, being located in both the chair back and the chair seat, and connecting to the back section; wherein the buttock section has an upward curve, and a massage distance from both the back massage surface and the seat massage surface; and a leg section, being located under the chair seat, and connecting to the buttock section; wherein the leg section has a downward curve relative to the buttock section; when the rotation angle is less than 110 degree, the leg section is away from the seat massage surface more than the massage distance; a massage provider, having a plurality of massage units, being located within the main frame and between the internal slide tracks, able to slide from the back section, the buttock section to the leg section, and from the leg section, the buttock section to the back section; wherein the massage provider can provide a massage service at both the chair back and the chair seat; wherein the massage units of the massage provider touches the back massage surface and the seat massage surface during providing the massage service; when the rotation angle is less than 110 degree, the leg section is away from the seat massage surface more than the massage distance, and the massage units of the massage provider stay away from the seat massage surface; a first rotation supporter, connecting to a first electrical cylinder; wherein the first rotation supporter has a first rotation terminal and a first moving terminal; the first rotation terminal is disposed under the main frame, and the first rotation supporter is driven by the first electrical cylinder, then rotating around the first rotation terminal; the first moving terminal is rotating and moving with the main frame during the first rotation supporter is rotating around the first rotation terminal; a second rotation supporter, having a second rotation terminal and a second moving terminal, connecting to the leg section of the main frame; wherein the second moving terminal is rotating and moving with the leg section during the main frame is moving; wherein the second rotation terminal is disposed under the main frame, so the second rotation supporter is rotating around the second rotation terminal during the second moving terminal is rotating and moving with the leg section; wherein the first rotation supporter rotates clockwise as the second rotation supporter rotates clockwise, and the main frame rotates counter-clockwise; wherein the first rotation supporter rotates counter-clockwise as the second rotation supporter rotates counter-clockwise, and the main frame rotates clockwise; a seat supporter, disposed within the chair seat, and connected to the first rotation supporter; a restriction supporter, connecting between the main frame and the seat supporter; due to the seat supporter is restricted by the restriction supporter, the rotation angle is greater as the first rotation supporter rotates clockwise and the main frame rotates counter-clockwise; due to the seat supporter is restricted by the restriction supporter, the rotation angle is smaller as the first rotation supporter rotates counter-clockwise and the main frame rotates clockwise; and a driving module, connecting to the massage provider and the first electrical cylinder, driving the massage provider to provide massage service, and driving the first electrical cylinder to work.

Moreover, the buttock section has an upward curve of radius within 110 mm to 210 mm; the leg section has a downward curve of radius within 90 mm to 270 mm; the upward curve of the buttock section is connected to the downward curve of the leg section.

In the present invention, each internal slide track further includes a pinion placing surface and a pinion drive, the pinion drive is fixed on the pinion placing surface; moreover, the massage provider has a plurality of gearwheel rotating on the pinion drive; and a sliding wheel accommodating slot; wherein the sliding wheel accommodating slot is connected by the pinion placing surface, and accommodates a plurality of sliding wheel of the massage provider; wherein the sliding wheel of the massage provider and gearwheel of the massage provider have the same rotation center.

The present invention further comprises a base, disposed under the main frame; wherein the first rotation terminal of the first rotation supporter and the second rotation terminal of the second rotation supporter are both disposed on the base; wherein the restriction supporter has two side supporting frames and two side restricted frames; the main frame is flanked by the side supporting frames, and the side supporting frames are disposed on the base; the side restricted frames connects between the side supporting frames and the seat supporter.

Also, the present invention has a foot massage device and a second electrical cylinder, both connecting to the driving module; wherein the foot massage device can provide massage service to foot; the foot massage device connects by the seat supporter, and the second electrical cylinder connects to the foot massage device; the foot massage device rotates by the seat supporter when the second electrical cylinder pushes the foot massage device; a cylinder supporter, connecting between the seat supporter and the second electrical cylinder.

DETAILED DESCRIPTION OF THE PREFERRED EMBODIMENTS

The technical contents and characteristics of the present invention will be apparent with the detailed description of a preferred embodiment accompanied with related drawings as follows. It is noteworthy that the drawings are provided for the purpose of illustrating the present invention, but not intended for limiting the scope of the invention.

Figure 1:
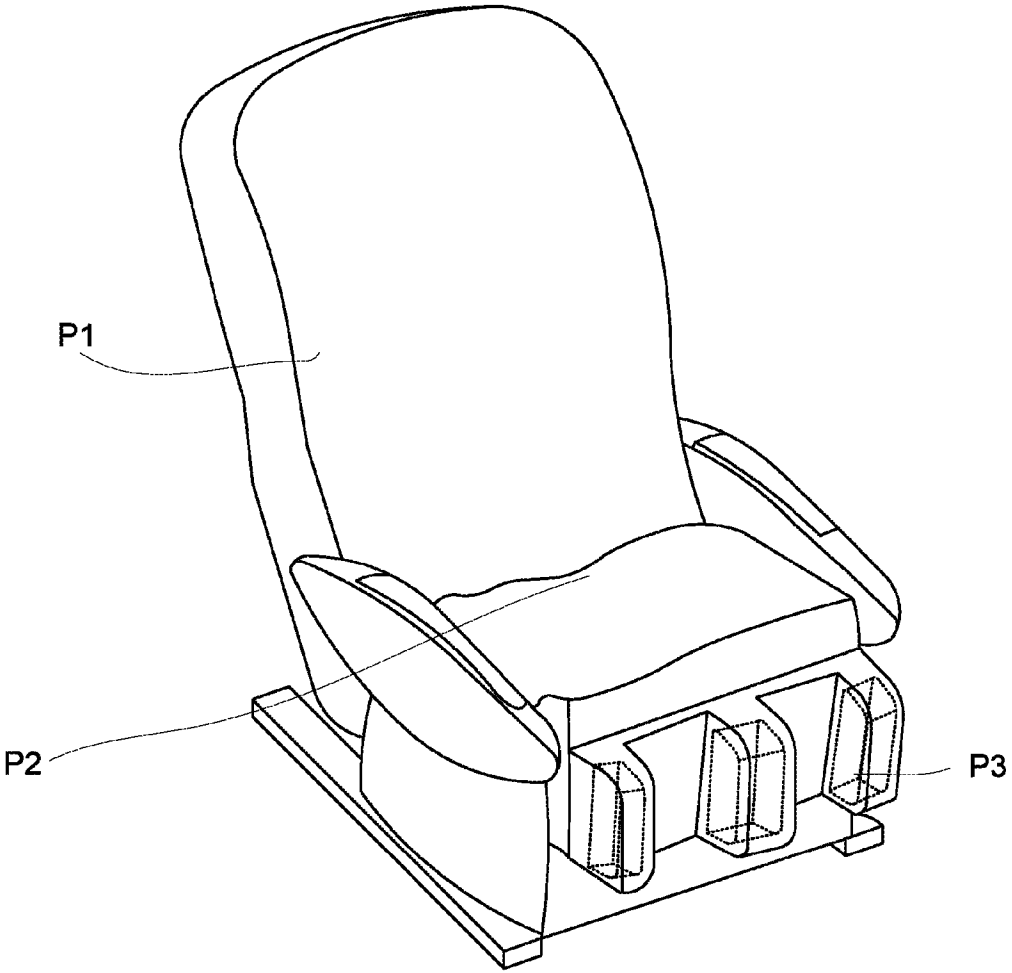
FIG. 1 (Prior Art)
FIG. 1 demonstrates a conventional massage chair.
Figure 2:
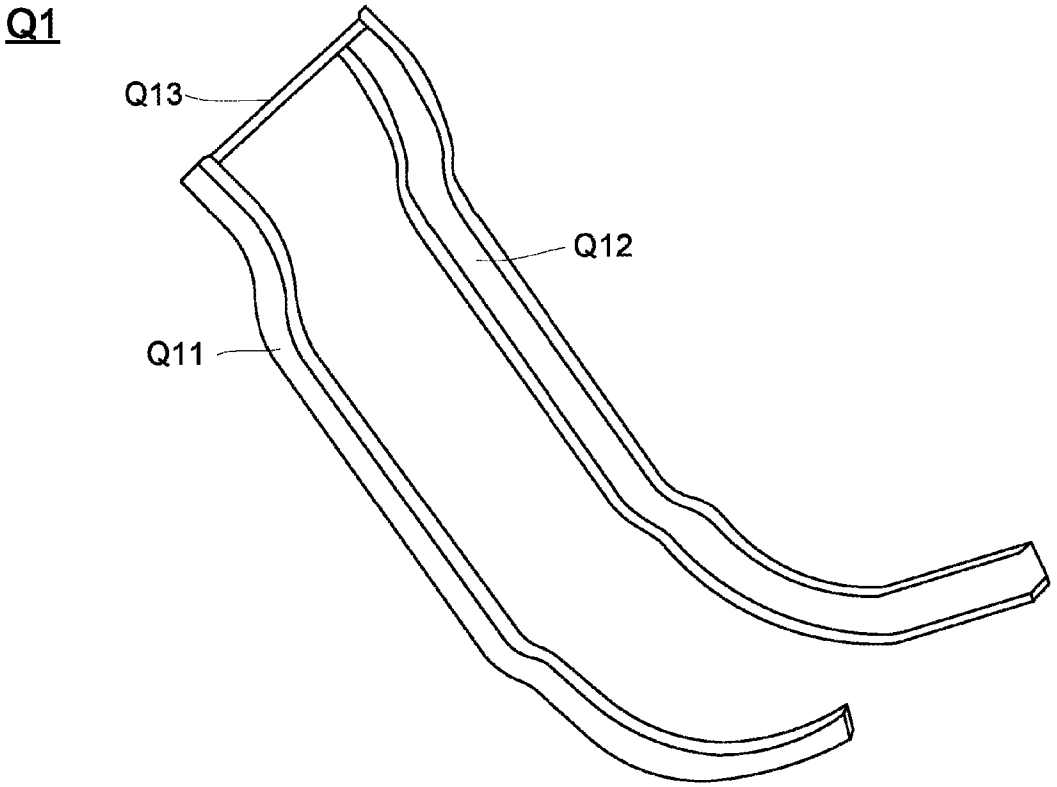
FIG.2 (Prior Art)
FIG. 2 demonstrates an L-type curved track module for conventional massage chair.
Figure 3A:
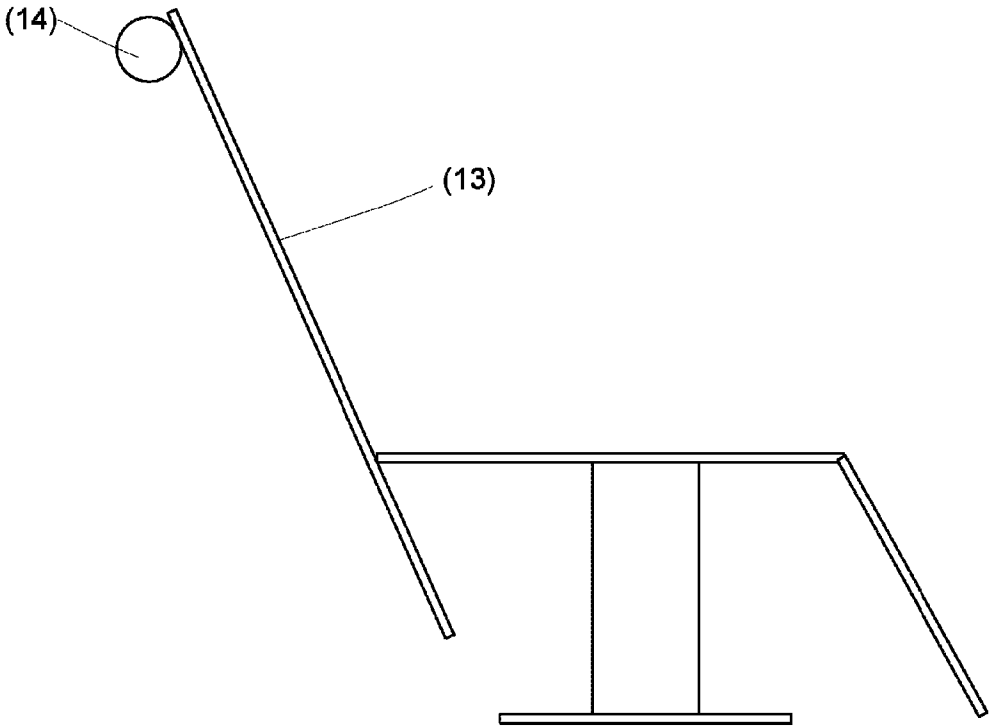
FIG.3A (Prior Art)
FIG. 3A and FIG. 3B demonstrate another conventional massage chair.
Figure 3B:
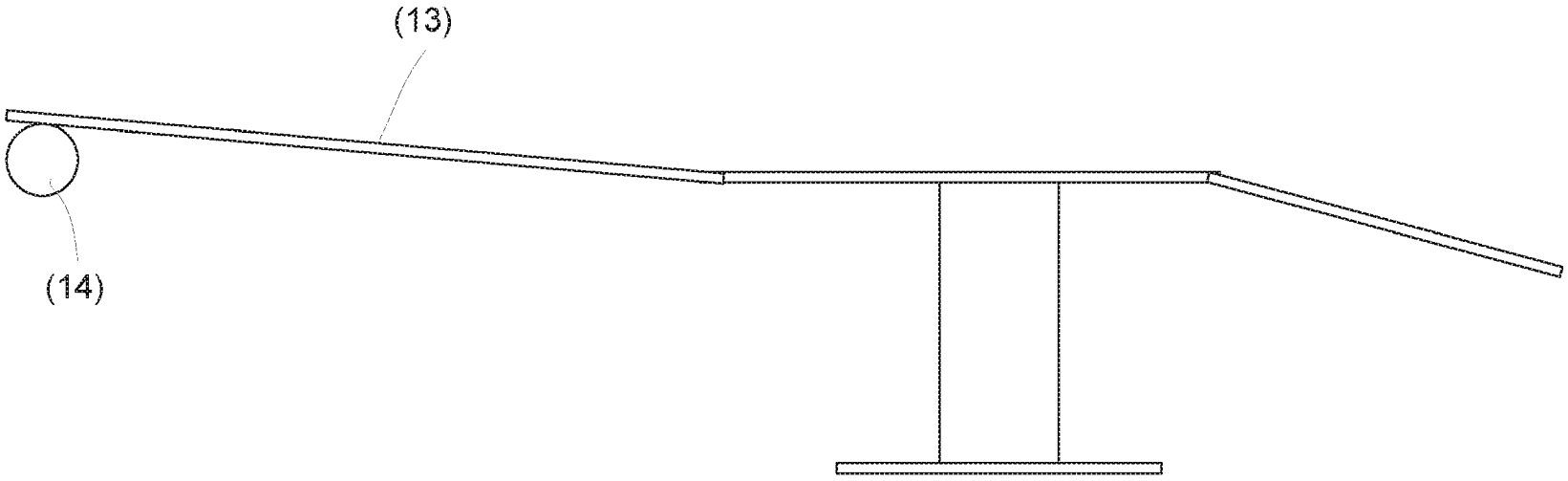
FIG.3B (Prior Art)
Figure 4:
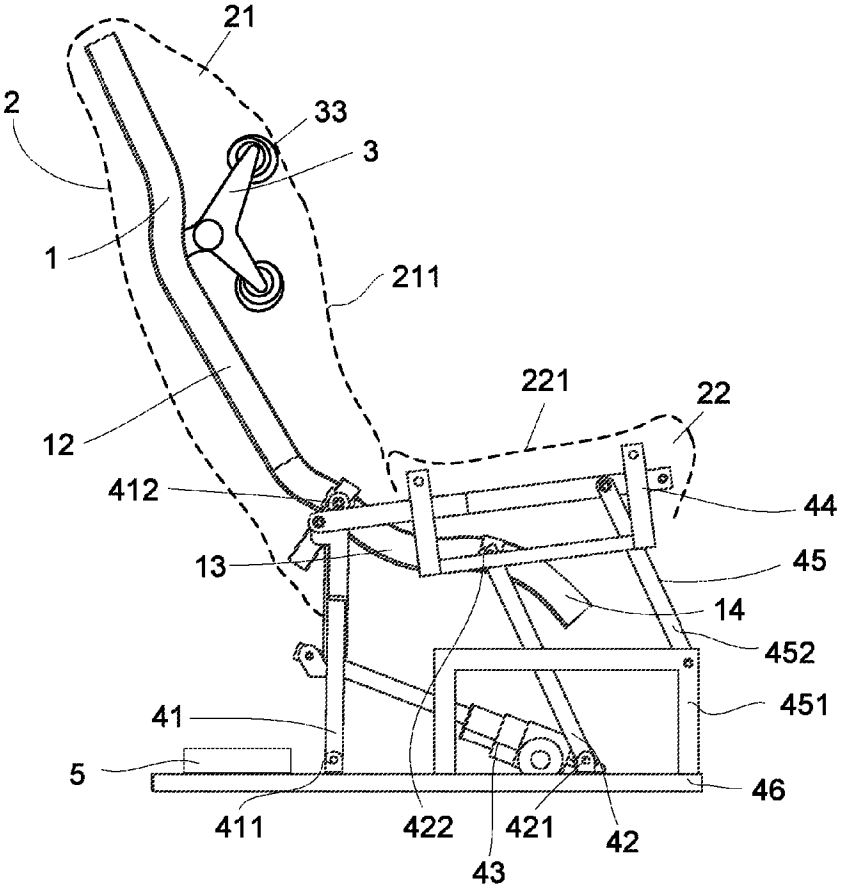
FIG. 4 demonstrates a side view of the massage chair according to the present invention.
Figure 5:
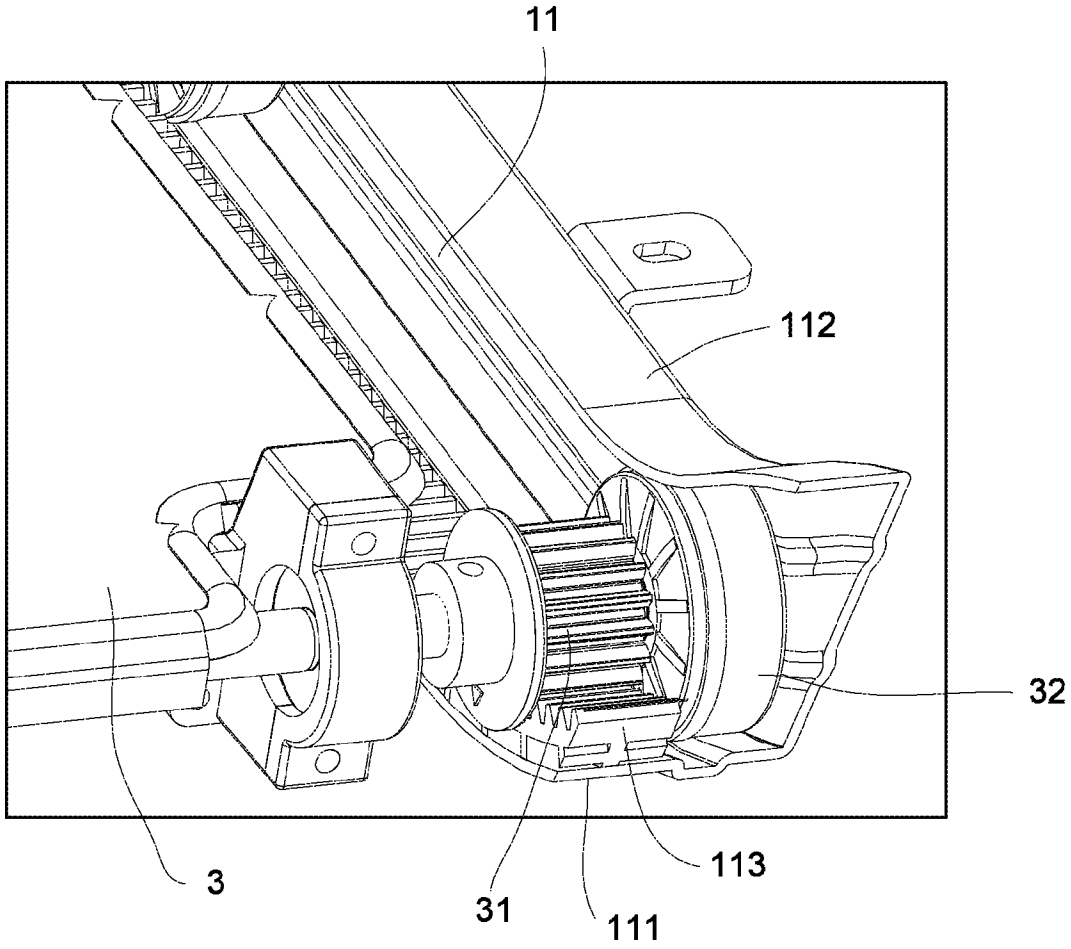
FIG. 5 demonstrates a partial section view of the internal slide track used in this invention.

Please refer to FIG. 4 and FIG. 5. FIG. 4 demonstrates a side view of the massage chair according to the present invention, FIG. 5 demonstrates a partial section view of the internal slide track used in this invention. As depicted in FIG. 4 and FIG. 5, this invention is a massage chair having curved track, including: a main chair 2, supporting human body, having a chair back 21 and a chair seat 22, wherein the chair back 21 is located by the chair seat 22 with a rotation angle, also being adjusted and rotating properly by the chair seat 22; wherein the chair back 21 has a back massage surface 211, the chair seat 22 has a seat massage surface 221; a main frame 1, being stiffness frame, and being located within the main chair 2; wherein, the main frame 1 has two internal slide tracks 11, and further comprises a back section 12, being located and fixed in the chair back 21, and having a massage distance from the back massage surface 211; a buttock section 13, being located in both the chair back 21 and the chair seat 22, and connecting to the back section 12; wherein the buttock section 13 has an upward curve, and a massage distance from both the back massage surface 211 and the seat massage surface 221; and a leg section 14, being located under the chair seat 22, and connecting to the buttock section 13; wherein the leg section 14 has a downward curve relative to the buttock section 13; when the rotation angle is less than 110 degree, the leg section 14 is away from the seat massage surface 221 more than the massage distance; a massage provider 3, having a plurality of massage units 33, being located within the main frame 1 and between the internal slide tracks 11, able to slide from the back section 12, the buttock section 13 to the leg section 14, and from the leg section 14, the buttock section 13 to the back section 12; wherein the massage provider 3 can provide a massage service at both the chair back 21 and the chair seat 22; wherein the massage units 33 of the massage provider 3 touches the back massage surface 211 and the seat massage surface 221 during providing the massage service; when the rotation angle is less than 110 degree, the leg section 14 is away from the seat massage surface 221 more than the massage distance, and the massage units 33 of the massage provider 3 stay away from the seat massage surface 221; a first rotation supporter 41, connecting to a first electrical cylinder 43; wherein the first rotation supporter 41 has a first rotation terminal 411 and a first moving terminal 412; the first rotation terminal 411 is disposed under the main frame 1, and the first rotation supporter 41 is driven by the first electrical cylinder 43, then rotating around the first rotation terminal 411; the first moving terminal 412 is rotating and moving with the main frame 1 during the first rotation supporter 41 is rotating around the first rotation terminal 411; a second rotation supporter 42, having a second rotation terminal 421 and a second moving terminal 422, connecting to the leg section 14 of the main frame 1; wherein the second moving terminal 422 is rotating and moving with the leg section 14 during the main frame 1 is moving; wherein the second rotation terminal 421 is disposed under the main frame 1, so the second rotation supporter 42 is rotating around the second rotation terminal 421 during the second moving terminal 422 is rotating and moving with the leg section 14; wherein the first rotation supporter 41 rotates clockwise as the second rotation supporter 42 rotates clockwise, and the main frame 1 rotates counter-clockwise; wherein the first rotation supporter 41 rotates counter-clockwise as the second rotation supporter 42 rotates counter-clockwise, and the main frame 1 rotates clockwise; a seat supporter 44, disposed within the chair seat 22, and connected to the first rotation supporter 41; a restriction supporter 45, connecting between the main frame 1 and the seat supporter 44; due to the seat supporter 44 is restricted by the restriction supporter 45, the rotation angle is greater as the first rotation supporter 41 rotates clockwise and the main frame 1 rotates counter-clockwise; due to the seat supporter 44 is restricted by the restriction supporter 45, the rotation angle is smaller as the first rotation supporter 41 rotates counter-clockwise and the main frame 1 rotates clockwise; and a driving module 5, connecting to the massage provider 3 and the first electrical cylinder 43, driving the massage provider 3 to provide massage service, and driving the first electrical cylinder 43 to work.

In the present invention, human back can lie on the chair back 21, human leg can lie on the chair seat 22, and human buttock can be located between the chair back 21 and the chair seat 22; the back massage surface 211 and the seat massage surface 221 can be made by elastic synthetic rubber, or leather material. Human feels comfortable with soft surface during massage service. Soft surface like elastic synthetic rubber, or leather material has elasticity, can transform according to human body, so stress is average on the soft surface, makes human comfortable. Moreover, human muscle can relax under comfortable feeling, so massage service is more effective.

Figure 6:
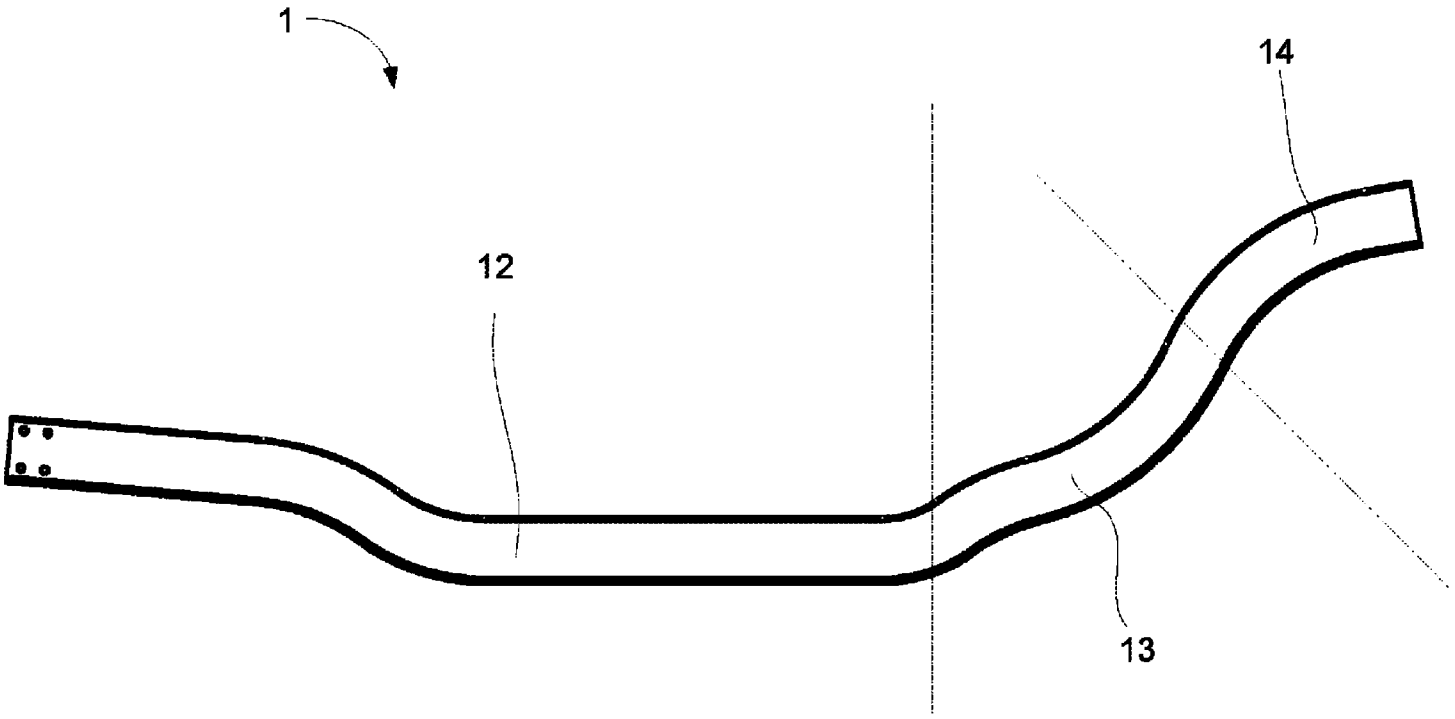
FIG. 6 demonstrates a side view of the main frame of the present invention.

Please refer to FIG. 6, demonstrating a side view of the main frame of the present invention. As depicted in FIG. 4 and FIG. 6, an upward curve of the buttock section 14 is used to accommodate human buttock, so the massage provider 3 can provide complete massage service to human buttock through the buttock section 14. The upward curve of the buttock section 14 can be adjusted according to human buttock size, so the buttock section 14 has an upward curve of radius within 110 mm to 210 mm. In terms of the downward curve of the leg section 14, the present invention provides a specific design. The user sits on the massage chair of the present invention is close to straight when the rotation angle is less than 110 degree, the massage provider 3 is unable to provide massage service to human leg through the leg section 14. The massage provider 3 is able to provide massage service after the rotation angle is greater than 110, so the leg section 15 has a downward curve of radius within 90 mm to 270 mm.

The upward curve of the buttock section 14 can be connected to the downward curve of the leg section 15 directly; adding another line or curve between the buttock section 14 and the leg section 15 is also available for custom request.

As shown in FIG. 5, each internal slide track 11 further includes a pinion placing surface 111 and a pinion drive 113, the pinion drive 113 is rack and pinion drive, fixed on the pinion placing surface 111, wherein the pinion placing surface 111 has rack and pinion surface; moreover, the massage provider 3 has a plurality of gearwheel 31 rotating on the pinion drive 113; moreover, the internal slide track 11 further includes a sliding wheel accommodating slot 112; wherein the sliding wheel accommodating slot 112 is connected by the pinion placing surface 111, and accommodates a plurality of sliding wheel 32 of the massage provider 3; wherein the sliding wheel 32 of the massage provider 3 and gearwheel 32 of the massage provider 3 have the same rotation center. The pinion placing surface 111 has pinion with specific shape as the pinion drive 113, so the pinion drive 113 can drive on the pinion placing surface 111 in stable condition without unexpected slipping issue. The unexpected slipping issue may cause the massage provider 3 has serious moving offset or shift between left side and right side, so the massage provider 3 inclines. The massage provider 3 then has wrong position and broken easily, so as the pinion drive 113, even worse by cutting off.

In the present invention, massage service means a mechanical operation providing particular massage effect to human body. Please refer to FIG. 4, the massage provider 3 slips in the main frame 1, provides proper knocking and rolling to human body, so the human body feels vibration and pressure effect when human sits on the massage chair. The vibration and pressure effect is the massage service to human body provided by the massage provider 3. The massage service can be adjusted according to custom design, for example, the size of the massage units 33, the moving speed of the massage units 33, and the intensity of the massage units 33 pressing on human body. Moreover, the massage provider 3 can provide various massage service in different position of the main frame 1, for example, the massage provider 3 moves fast in the back section 12, and keeps return, so the human back has complete massage service. Also, the massage provider 3 moves slowly in the buttock section 13 and presses hard, so the human body can feels various massage service in different position.

Figure 7:
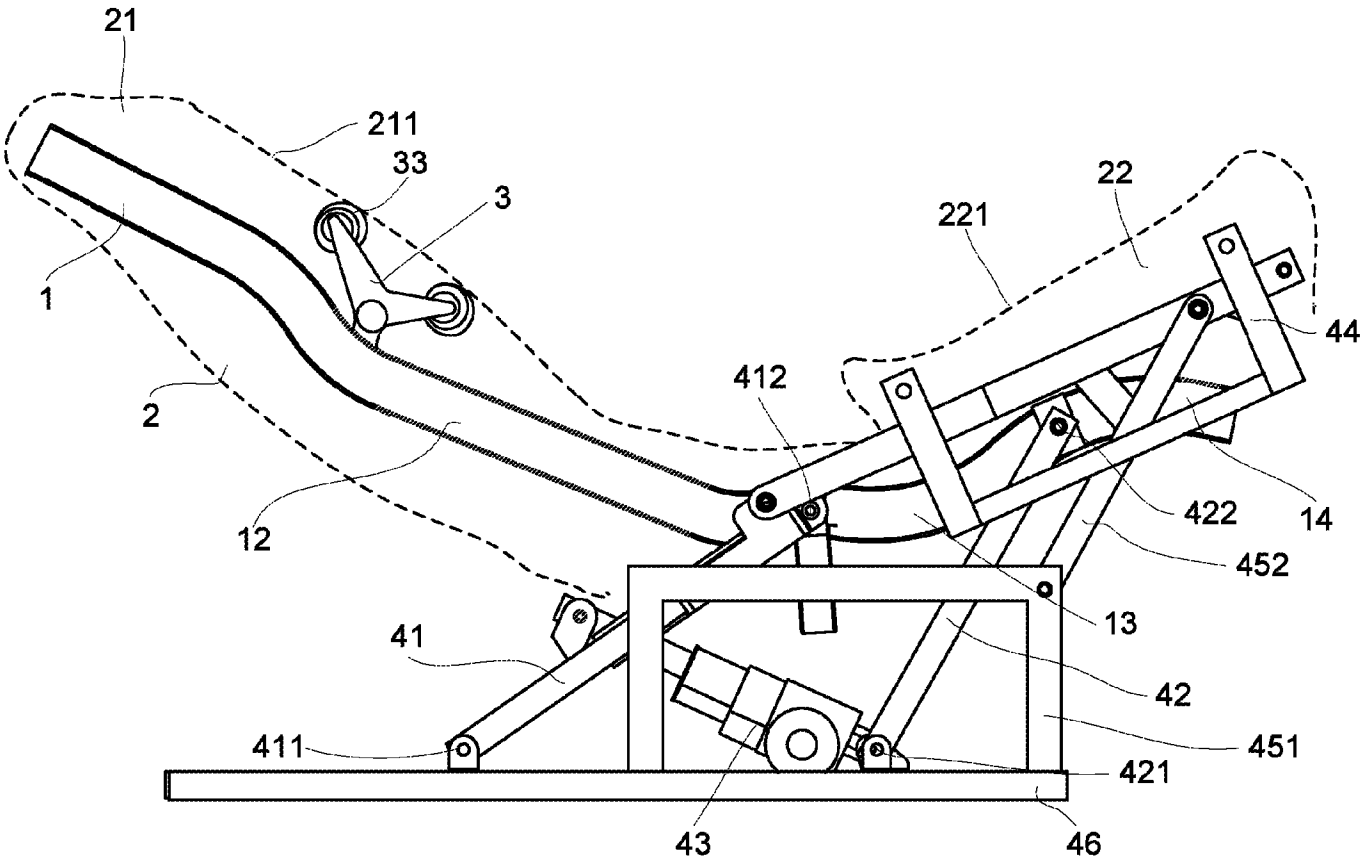
FIG. 7 demonstrates status of chair back and chair seat having the rotation angel greater than 110 degree.

Please refer to FIG. 7, demonstrating status of chair back and chair seat having the rotation angel greater than 110 degree. As depicted in FIG. 4 and FIG. 7, the massage distance in the present invention means a distance that the massage provider 3 is able to provide massage service to human body. The massage provider 3 is unable to press the seat massage surface 221 when the leg section 14 is away from the seat massage surface 221 more than the massage distance, and the massage provider 3 is able to press the seat massage surface 221 when the leg section 14 is away from the seat massage surface 221 less than the massage distance. The main frame 1 has particular curved shape, the back section 12 has massage distance from the back massage surface 211 and the buttock section 13 has massage distance from both the back massage surface 211 and the seat massage surface 221, so the massage units 33 of the massage provider 3 are able to press the back massage surface 211 or the seat massage surface 221 when the massage provider 3 is in the back section 12 or the buttock section 13. As shown in FIG. 4, the leg section 14 is away from the seat massage surface 221 when the rotation angel is less than 110 degree, the massage units 33 keep contactless with the seat massage surface 221, and the massage provider 3 is unable to provide massage service to human leg. As shown in FIG. 7, the leg section 14 is close to the seat massage surface 221 as the rotation angel is greater. The massage units 33 touch the seat massage surface 221 after the rotation angel is greater than 110 degree, and the massage provider 3 further initiates to provide massage service. The massage provider 3 can adjust the intensity of the massage units 33 as the rotation angel is greater, to make comfortable to the human leg.

Please refer to FIG. 4 and FIG. 7. The massage chair having curved track further comprises a base 46, disposed under the main frame 1; wherein the first rotation terminal 411 of the first rotation supporter 41 and the second rotation terminal 421 of the second rotation supporter 42 are both disposed on the base 46; the restriction supporter 45 has two side supporting frames 451 and two side restricted frames 452;

the main frame 1 is flanked by the side supporting frames 451, and the side supporting frames 451 are disposed on the base 46; the side restricted frames 452 connects between the side supporting frames 451 and the seat supporter 44.

Figure 8:
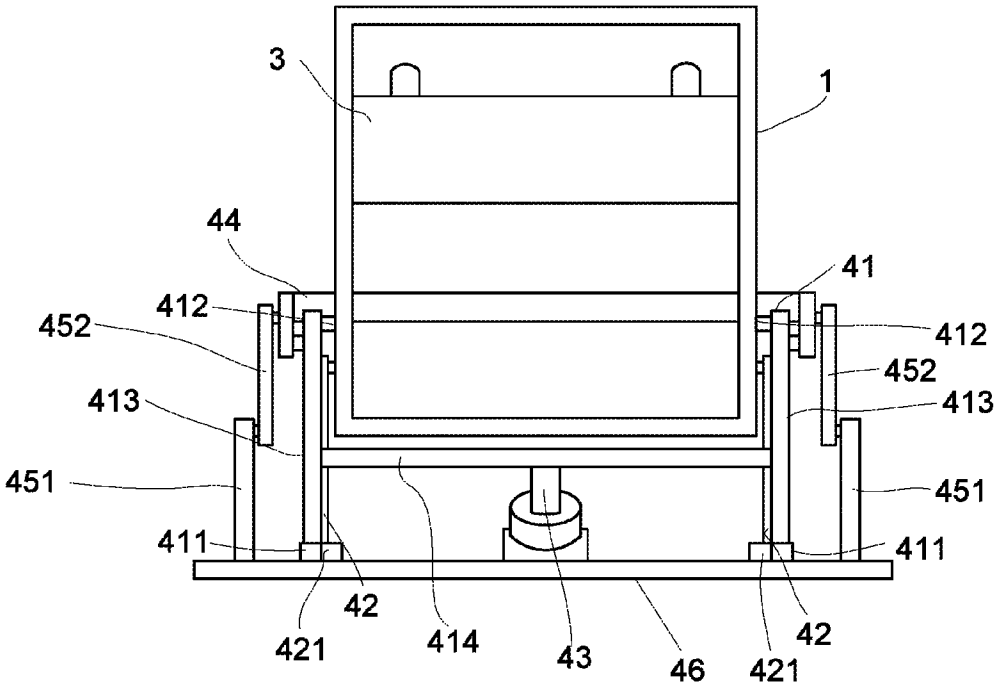
FIG. 8 demonstrates a rear view of the massage chair having curved track according to the present invention.

Please refer to FIG. 8, demonstrating a rear view of the massage chair having curved track according to the present invention. The first rotation supporter 41 has two long posts 413 flanked the main frame 1, and a link post 414 connects between the long posts 413. The long posts 413 can connect to the position between the back section 12 and the buttock section 13, or connect to the back section 12 closed to the buttock section 13, or connect to the buttock section 13 closed to the back section 12. The link post 414 also connects to the first electrical cylinder 43, thus, the first electrical cylinder 43 pushes the link post 414 to further push the first rotation supporter 41. The second rotation supporter 42 has two posts, flanked the main frame 1. Alternatively, the second rotation supporter 42 can be one posts disposed to the main frame 1 and the base 46. The two post used in the second rotation supporter 42 is one embodiment of the present invention.

In the first rotation supporter 41, bearing can be disposed at the first rotation terminal 411 and the first moving terminal 412, for rotation; wherein the bearing is a machine element that constrains relative motion and reduces friction between moving parts. In the second rotation supporter 42, bearing can be disposed at the second rotation terminal 421 and the second moving terminal 422. Except bearing, carbon fiber element can also be selectively disposed at the first rotation terminal 411 and the first moving terminal 412 adding with lubricating oil, for the same rotation. The carbon fiber element has shorter life time than bearing, however, has cheaper price, and more convenient in manufacturing process with less accuracy than bearing. Consistently, carbon fiber element can also be disposed at the second rotation terminal 421 and the second moving terminal 422.

As shown in FIG. 4, the seat supporter 44 is used to support human buttock and leg. Human weight is downward due to gravity, so the seat supporter 44 has almost the weight. The soft plate or sheet can be placed between the seat supporter 44 and the chair seat 22 for increasing comfortable as well as painful cause by massage service.

Figure 9:
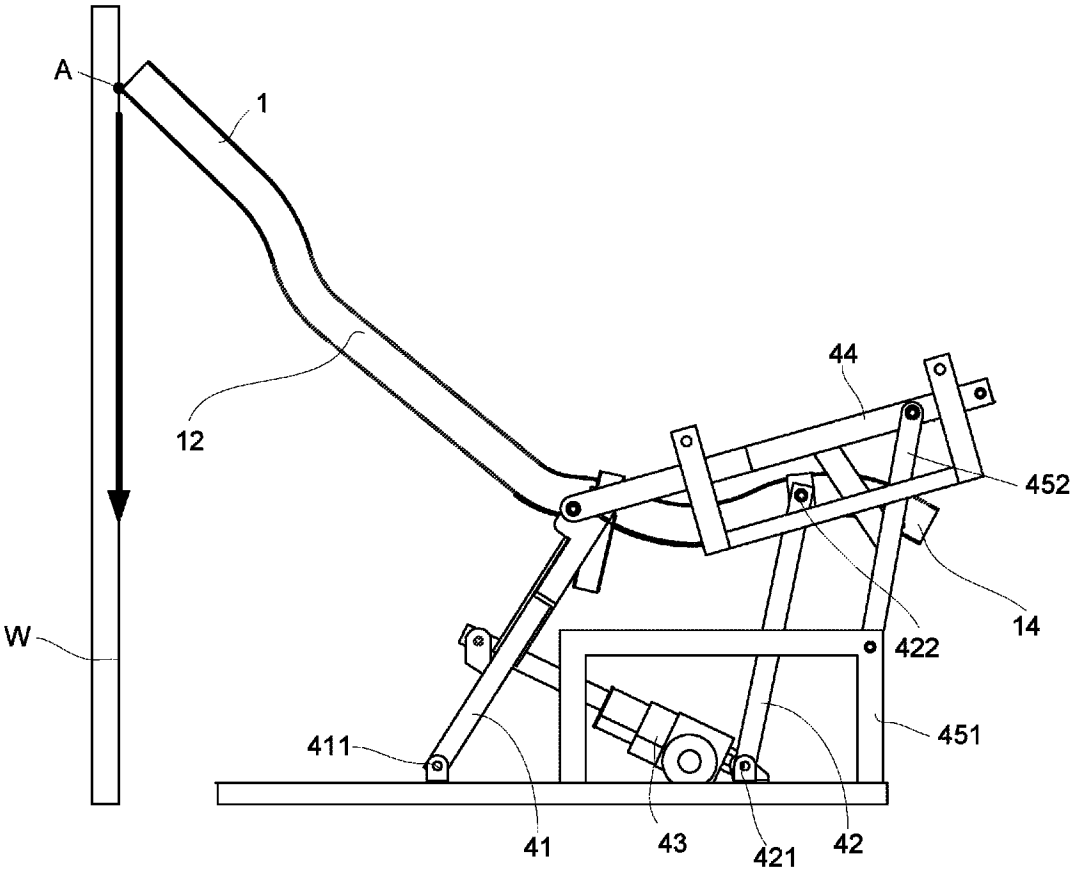
FIG. 9 demonstrates the first motion of the massage chair according to the present invention.
Figure 10:
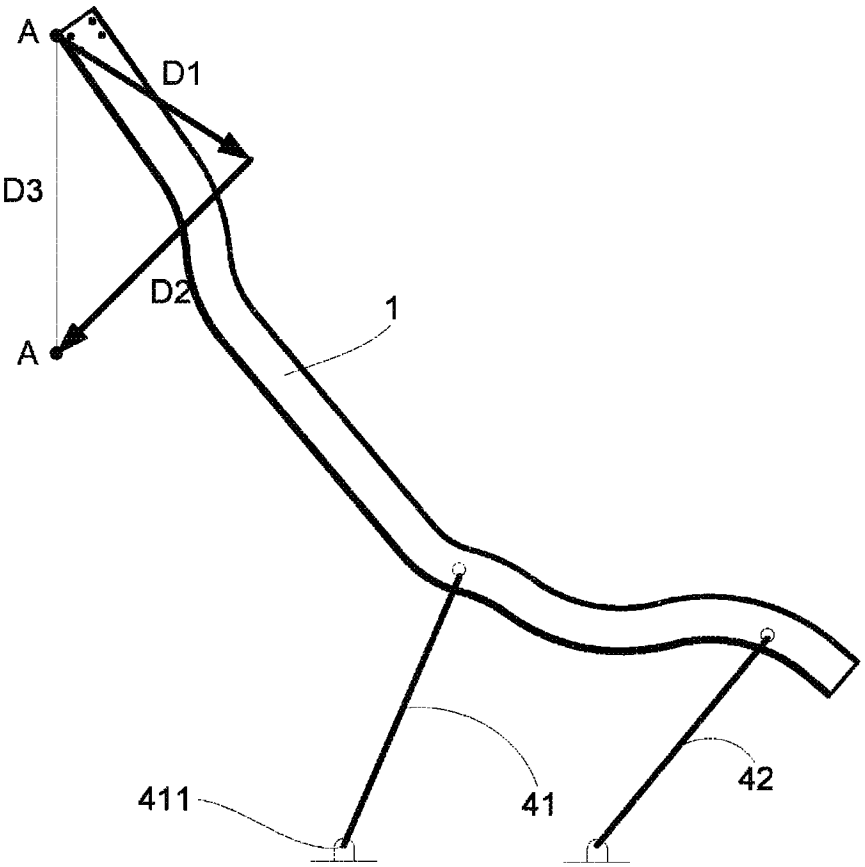
FIG. 10 demonstrates the second motion of the massage chair according the present invention.

Please refer to FIG. 9 and FIG. 10, the FIG. 9 demonstrates the first motion of the massage chair according to the present invention, the FIG. 10 demonstrates the second motion of the massage chair according the present invention. As depicted in FIG. 9 and FIG. 10, a reference point A of the main frame 1 is close to a wall W. The main frame 1 rotates counterclockwise when the first rotation supporter 41 and the second rotation supporter 42 rotate clockwise, and the reference point A moves down along the wall W. The main frame 1 rotates clockwise when the first rotation supporter 41 and the second rotation supporter 42 rotate counterclockwise, and the reference point A moves up along the wall W.

As shown in FIG. 10, the first rotation supporter 41 rotates an angle in clockwise, and the main frame 1 moves, so the reference point A moves a first displacement D 1. Simultaneously, the second rotation supporter 42 is fixed on the leg section 14, so the second rotation supporter 42 moves the main frame 1 to rotate, and the reference point A moves a second displacement D2. Consequently, the reference point A actually has a third displacement D3. The third displacement D3 is downward and close to straight moving. Alternatively, the third displacement D3 can be upward. Therefore, the reference point A can always move along the wall W.

From above description, the horizontal axis of the first displacement D1 and the second displacement D2 can be controlled equally to keep the reference point A moves straight. The length and the rotation angle to the first rotation supporter 41 effect the first displacement D1. The distance from the reference point A to one end of the second rotation supporter 42 connected to the main frame 1 effects the second displacement D2, also, the length and the rotation angle of the second rotation supporter 42 can effect displacement D2. The first displacement D1 and the second displacement D2 can be adjusted to keep the horizontal axis equally. For example, the distance from the reference point A to one end of the second rotation supporter 42 connected to the main frame 1 is longer as the first rotation supporter 41 is longer. Moreover, the moving speed to the first displacement D1 and the second displacement D2 is also considered, which means the reference point A moving straight is decided by the displacement per time of the first displacement D1 and the displacement per time of the second displacement D2. Thus, the third displacement D3 can be vertical when the horizontal axis of the first displacement D1 and the second displacement D2 are equal.

The reference point A can move straight, so the massage chair of the present invention can be located close to wall without blocking by wall in any status, and spare the certain space.

Figure 11:
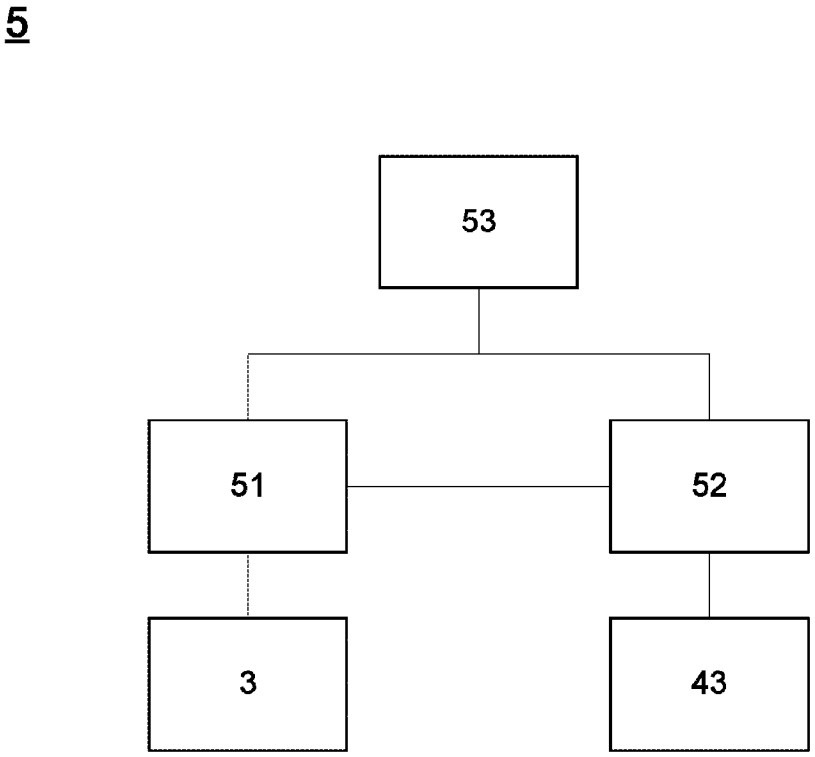
FIG. 11 demonstrates a control unit to the driving module of the present invention.

Please refer to FIG. 11, demonstrating a control unit to the driving module of the present invention. As depicted in FIG. 11, the driving module 5 comprises a massage driver 51, a first electrical cylinder driver 52 and a data storage 53. The data storage 53 stores a plurality of massage service program and cylinder driving program. The massage driver 51 connects to the data storage 53, and accesses a massage service program to drive the massage provider 3. Each massage service program has different setting, so the massage provider has different massage service according to different massage service program. For example, faster speed or more pressure. Each setting can be adjusted for custom and stored for access. The massage driver 51 can access massage service program from the data storage 53 and drives the massage provider 3 to perform certain massage service. The first electrical cylinder driver 52 connects to the first electrical cylinder 43, accesses the cylinder driving program from the data storage 53 and drives the first electrical cylinder 43. Each cylinder driving program has different setting including work speed and work time. The work speed means the pistons moving speed of the first electrical cylinder 43 during working, and the work time means the time from start working to stop working. Please refer to FIG. 4, the massage provider 3 starts to provide massage service, after three minutes, the first electrical cylinder 43 start to push until the piston to the end. The massage driver 51 can also connect to the first electrical cylinder driver 52. After the first electrical cylinder driver 52 drives the first electrical cylinder 43, the massage driver 51 can adjust and control the massage provider 3 properly, change massage service, due to the weight on the massage chair changed, avoiding the weight effect the performance of the massage service.

Figure 12:
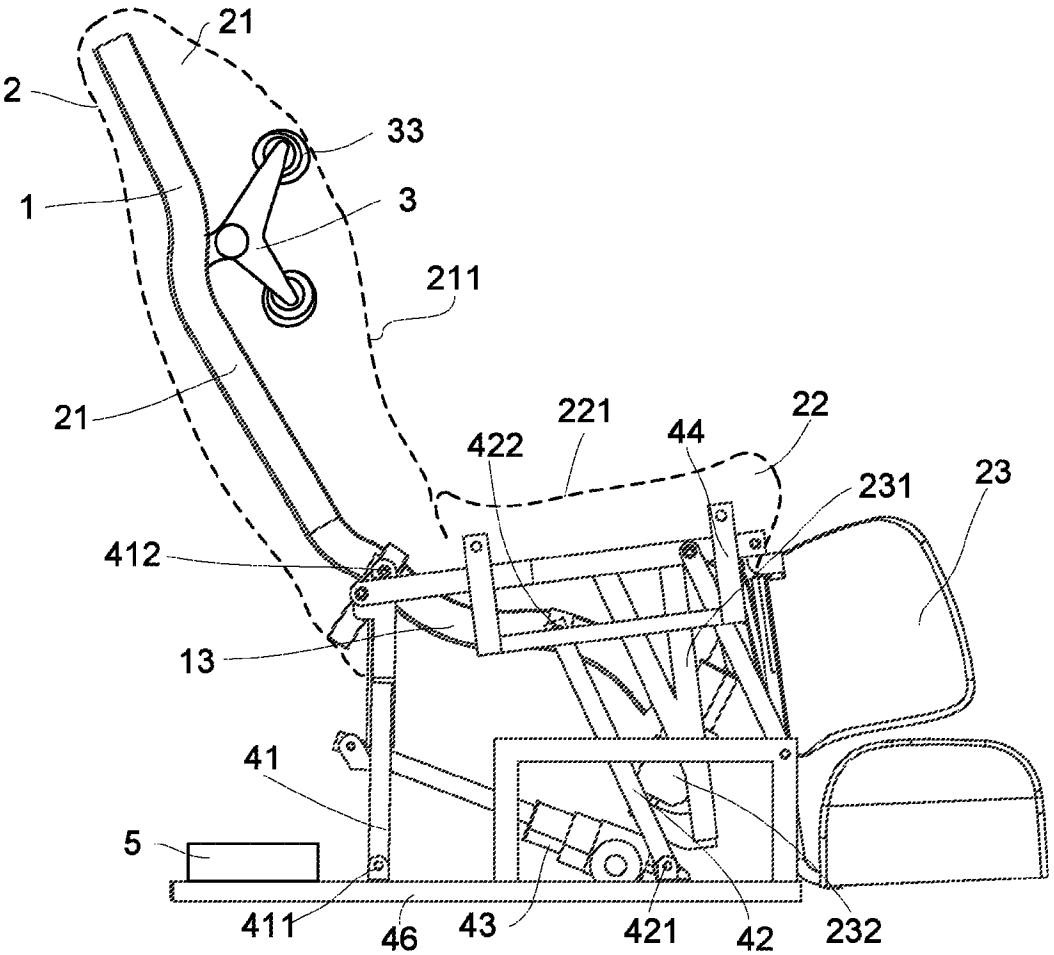
FIG. 12 demonstrates a side view of the massage chair with foot massage provider according to the present invention.

Please refer to FIG. 12, demonstrating a side view of the massage chair with foot massage provider according to the present invention. As shown in FIG. 12, the massage chair of the present invention further comprises a foot massage device 23 and a second electrical cylinder 232, both connecting to the driving module 5; wherein the foot massage device 23 can provide massage service to foot; the foot massage device 23 connects by the seat supporter 44, and the second electrical cylinder 232 connects to the foot massage device 23; the foot massage device 23 rotates by the seat supporter 44 when the second electrical cylinder 232 pushes the foot massage device 23. In the present invention, the foot massage device 23 has many mechanical massage designs for massage service, and the massage service can be performed at the part including the calf of the leg, side of the leg, ankle and the bottom of the foot. The massage service can be also adjusted the pressure and time.

As shown in FIG. 12, a cylinder supporter 231, connecting between the seat supporter 44 and the second electrical cylinder 232. The foot massage device 23 is restricted by the cylinder supporter 231 and being lifted up when the seat supporter 44 moves up. If the second electrical cylinder 232 is disposed on the base 46, the foot massage device 23 must be lifted up when the seat supporter 44 moves up, or the human leg is extracted from the foot massage device 23. Consider the inconvenient issue, the present invention has design to cylinder supporter 231 which fixed to the seat supporter 44 and connects to the second electrical cylinder 232. The foot massage device 23 being lifted up is not driven by the second electrical cylinder 232 but followed by the seat supporter 44 moving up, and the human leg can be located in the foot massage device 23 with the same bending angle. The human leg bending angle can be changed by the second electrical cylinder 232, and the massage service changes as the weight changes to the calf of the leg in the foot massage device 23.

Figure 13:
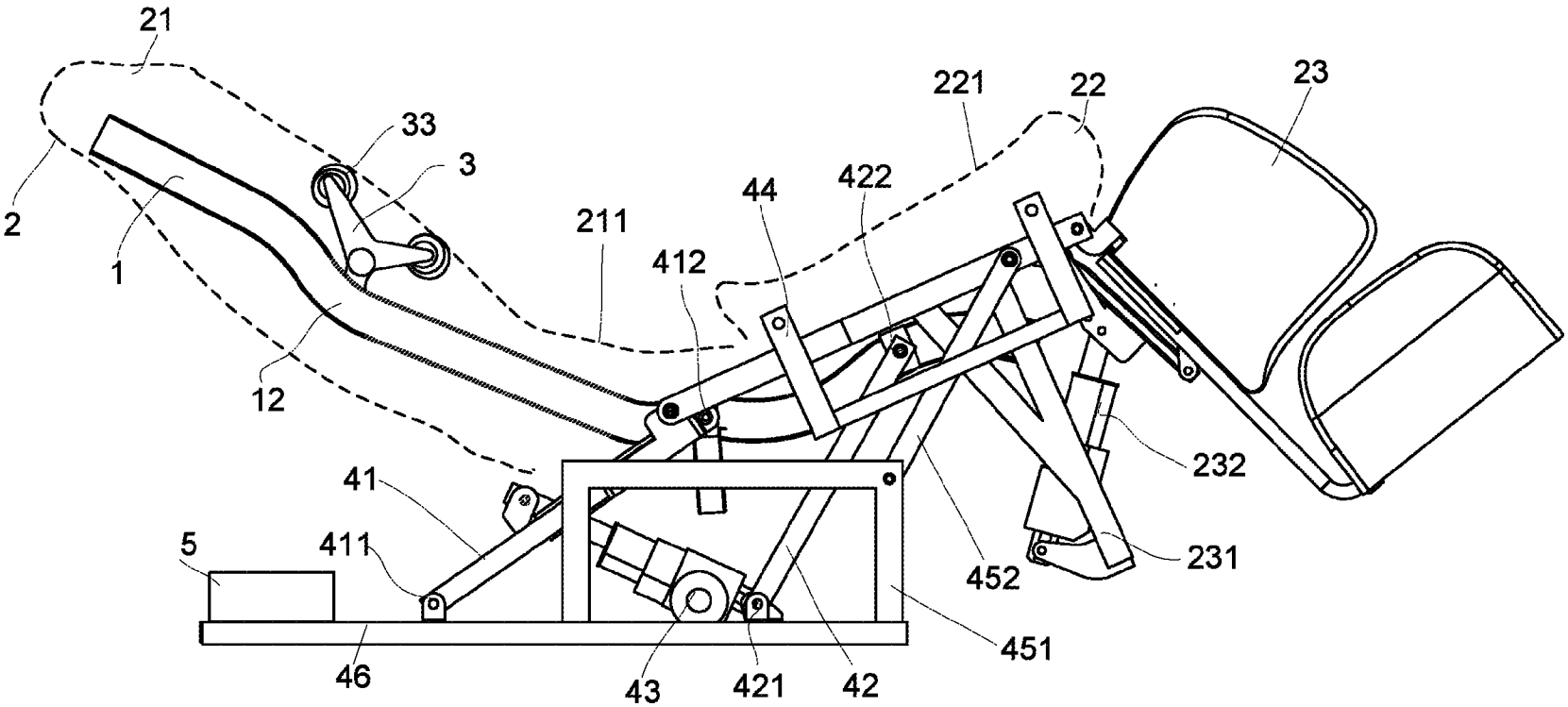
FIG. 13 demonstrates another side view of the massage chair with foot massage provider according to the present invention.
Figure 14:
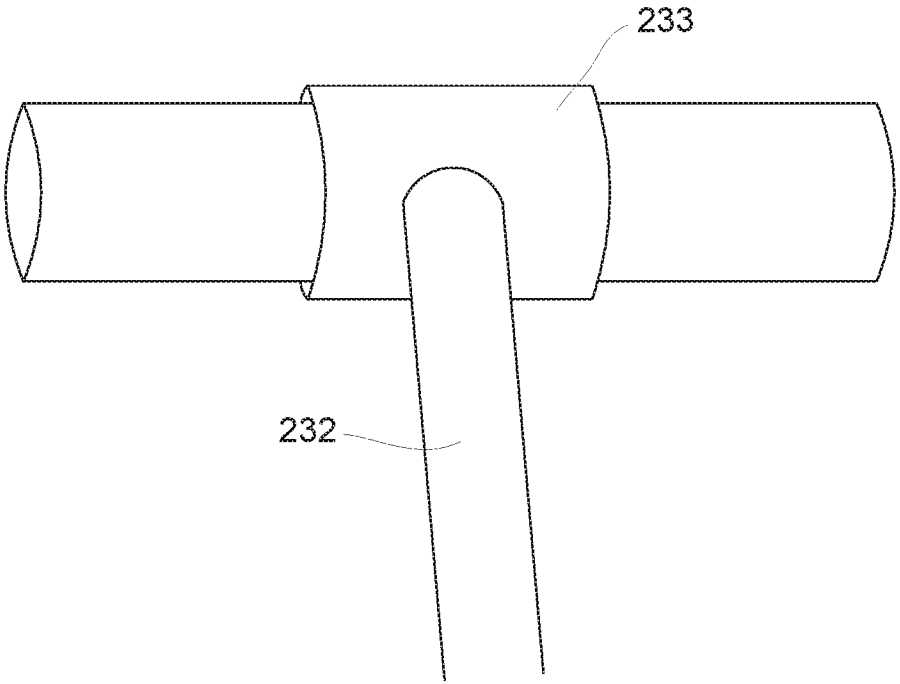
FIG. 14 demonstrates second electrical cylinder connecting to foot massage device.

Please refer to FIG. 13 and FIG. 14. The FIG. 13 demonstrates another side view of the massage chair with foot massage provider according to the present invention, and the FIG. 14 demonstrates second electrical cylinder connecting to foot massage device. A frame is disposed on the back of the foot massage device 23. When the second electrical cylinder 232 drives the foot massage device 23, the angle between the second electrical cylinder 232 and the foot massage device 23 changes, thus, a bearing is request to dispose between the second electrical cylinder 232 and the foot massage device 23. As shown in FIG. 14, the second electrical cylinder 232 connects to the back of the foot massage device 23 through a rotating bearing 233. The rotating bearing 233 is disposed on the back of the foot massage device 23, and the second electrical cylinder 232 is connects to the rotating bearing 233. So that, as shown in FIG. 13, the second electrical cylinder 232 drives the foot massage device 23 as the rotating bearing 233 rotates on the back of the foot massage device 23, and the foot massage device 23 is lifted up successfully.

The cylinder supporter 231 can be various form, changes the amount of the members. In the present invention, the cylinder supporter 231 has two frame members, connecting to the interior of the seat supporter 44 and the second electrical cylinder 232. More detail, the frame member connects to the second electrical cylinder 232 through rotation shaft. The rotation shaft passes through the frame member and the second electrical cylinder 232.

As shown in FIG. 12 and FIG. 13, the first electrical cylinder 43 and the second electrical cylinder 232 both have piston component which is driven by electricity. However, the first electrical cylinder 43 and the second electrical cylinder 232 can be replaced by pneumatic cylinders, or can be electrical and pneumatic hybrid cylinders. Besides, the first electrical cylinder 43 and the second electrical cylinder 232 both have two position sensors. One sensor being triggered means the piston might be out of limit, so the cylinder stops to initiate default procedure. The cylinder might have damage when the piston is out of limit, so proper stopping piston is necessary. After position sensor triggered, cylinder stops, and piston moves to another position sensor for initiation, also the distance between two position sensors is measured to compare with default value. If the distance meets the default value, cylinder can be back to work. If the distance does not meet the default value, component might be broken or disable, then cylinder should stop, so the massage chair.

Figure 15:
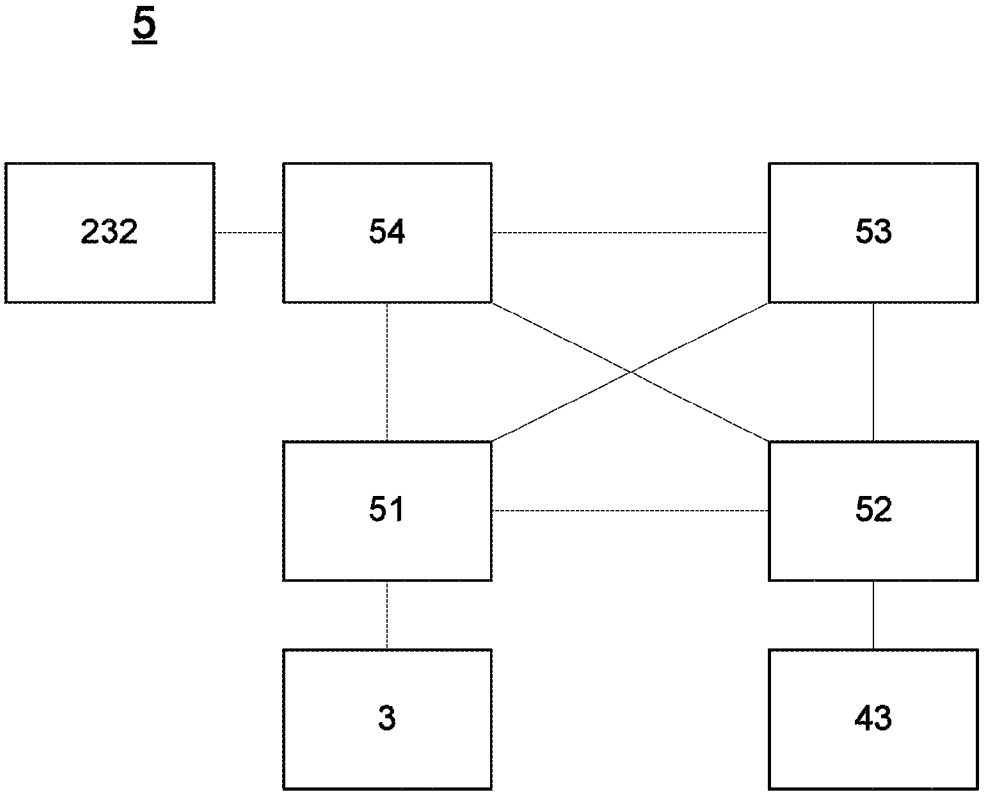
FIG. 15 demonstrates another control unit to the driving module of the present invention.

Please refer to FIG. 15, demonstrating another control unit to the driving module of the present invention. As depicted in FIG. 15, the driving module 5 further comprises a second electrical cylinder driver 54, driving the second electrical cylinder 232, and including the position, time and speed. In the present invention, the massage driver 51, the first electrical cylinder driver 52, the data storage 53 and the second electrical cylinder driver 54 are connected each other, for mutual transferring, and providing variety massage service. For example, the first electrical cylinder driver 52 drives the first electrical cylinder 43, and the massage driver 51 drives the massage provider 3 in a certain time, so the second electrical cylinder driver 54 drives the second electrical cylinder 232 in a certain time, wherein the certain time stored in the data storage 53 can be modified as request.

Please refer to FIG. 13, the status of the main frame 1 and the foot massage device 23 can be adjusted as user request, for example, when the main frame 1 is almost lied down, the rotation angle of the foot massage device 23 can be adjusted by manual instead of automatic.

Figure 16:
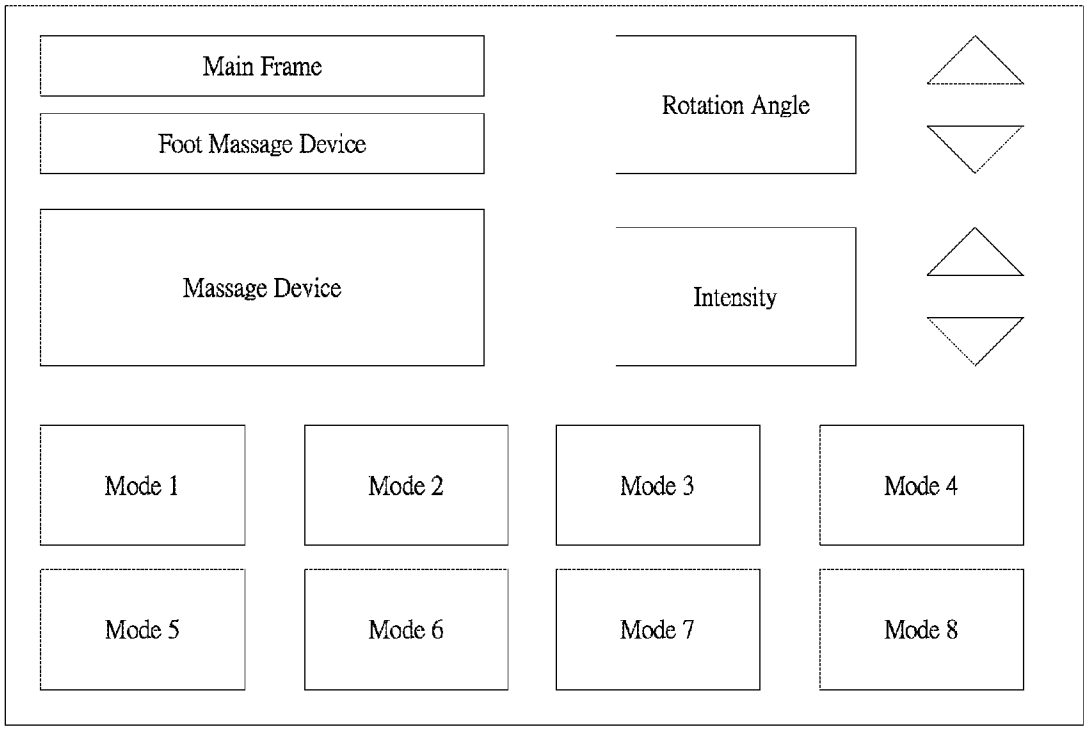
FIG. 16 demonstrates a control board of the massage chair.

Please refer to FIG. 16, demonstrating a control board of the massage chair. Also refer to FIG. 13 and FIG. 14. A control board 6 has mode 1 to mode 8, each mode represent one massage service. Buttons on the control board 6 can always be pressed during the main frame 1 rotation for stopping automatic mode, and the rotation angle of the main frame 1 can be changed to make user comfortable, so the intensity of the massage provider 3. Thus, the massage service can be changed for each request. In the present invention, the control board 6 can also be touch panel.

Figure 17A:
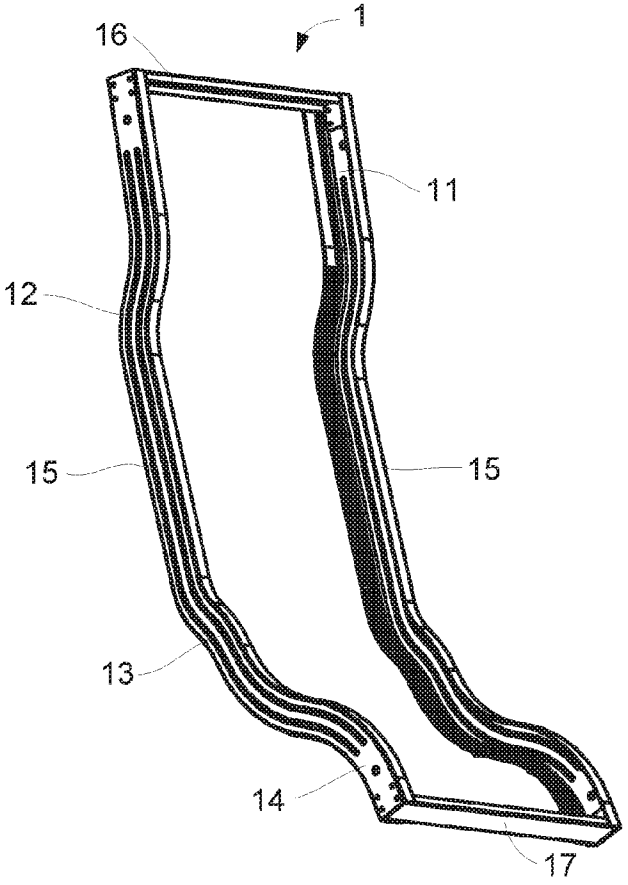
FIG. 17A and FIG. 17B demonstrate stereo view of main frame of the present invention.
Figure 17B:
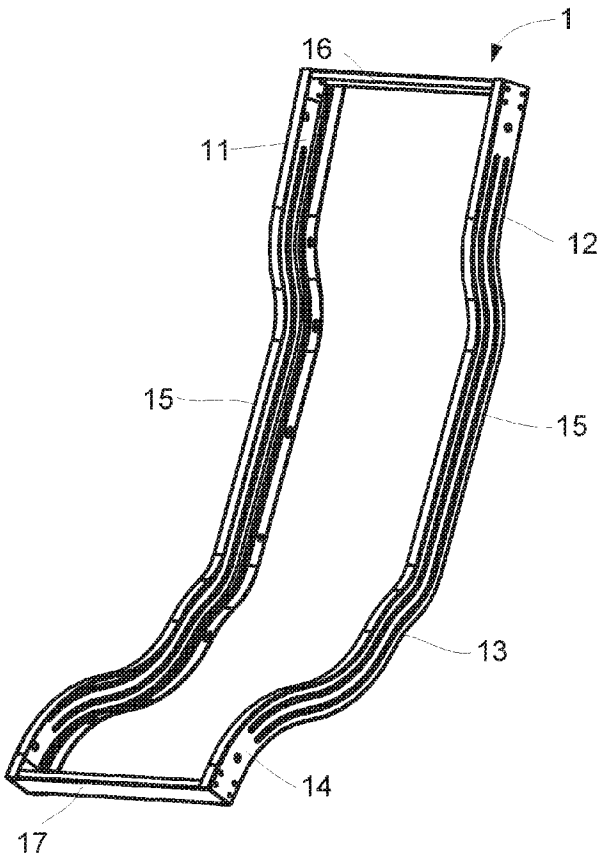

Please refer to FIG. 17A and FIG. 17B, demonstrating stereo view of main frame of the present invention. As depicted in FIG. 17A and FIG. 17B, the main frame 1 has two opposite side straight members 15, each side straight member 15 has one internal slide track 11, and further includes a back section 12, a buttock section 13 and a leg section 14. Two side straight members 15 are fixed by upper member 16 and lower member 17. The internal slide tracks 11 are formed inside the main frame 1.

The structure of this invention has been clearly elaborated in the aforementioned content. In summary, it contains the following advantages:

(1) The rotation angle can be adjusted, so human body is able to stretch and relax instead of fixed posture, also, human body has massage service from shoulder to buttock under any status.

(2) The leg section has a downward curve, thus, massage provider is able to provide massage service to human leg when rotation angle is greater than 110 degree, for overall massage effect.

(3) The reference point moves straight during the main frame rotates, so the massage chair can be located close to wall, and the space can be saved.

(4) Using mechanism principle to design mechanical structure makes reference point moving straight, instead of computing by microcomputer, so the present invention has lower cost with fast manufacturing with high accuracy.

(5) The main structure of the present invention almost moves straight downward, the base has less torque, and the massage chair is not easily falling down but stable for user to have massage service.

(6) The cylinder supporter connects to the seat supporter, and connects to the second electrical cylinder on the other end, so the foot massage device being lifted up is not driven by the second electrical cylinder but followed by the seat supporter moving up, and the human leg can be located in the foot massage device with the same bending angle.

While the invention has been described by means of specific embodiments, numerous modifications and variations could be made thereto by those skilled in the art without departing from the scope and spirit of the invention set forth in the claims.

What is claimed is:

1. A massage chair having curved track, including:

a main chair, supporting human body, having a chair back and a chair seat, wherein the chair back is located by the chair seat, and having a rotation angle between the chair back and the chair seat, also being adjusted and rotating properly by the chair seat; wherein the chair back has a back massage surface, the chair seat has a seat massage surface;

a main frame, being stiffness frame, and being located within the main chair; wherein, the main frame has two internal slide tracks, and further comprises:

a back section, being located and fixed in the chair back;

a buttock section, being located in both the chair back and the chair seat, and connecting to the back section; wherein the buttock section has an upward curve; and a leg section, being located under the chair seat, and connecting to the buttock section; wherein the leg section has a downward curve relative to the buttock section;

a massage provider, having a plurality of massage units, being located within the main frame and between the internal slide tracks, able to slide from the back section, the buttock section to the leg section, also from the leg section, the buttock section to the back section; wherein the massage provider can provide a massage service at both the chair back and the chair seat; wherein the massage units of the massage provider touch the back massage surface and the seat massage surface during providing the massage service;

a first rotation supporter, connecting to a first electrical cylinder; wherein the first rotation supporter has a first rotation terminal and a first moving terminal; the first rotation terminal is disposed under the main frame, and the first rotation supporter is driven by the first electrical cylinder, then rotating around the first rotation terminal; the first moving terminal is rotating and moving with the main frame during the first rotation supporter is rotating around the first rotation terminal;

a second rotation supporter, having a second rotation terminal and a second moving terminal, connecting to the leg section of the main frame; wherein the second moving terminal is rotating and moving with the leg section during the main frame is moving; wherein the second rotation terminal is disposed under the main frame, so the second rotation supporter is rotating around the second rotation terminal during the second moving terminal is rotating and moving with the leg section; wherein the first rotation supporter rotates clockwise as the second rotation supporter rotates clockwise, and the main frame rotates counter-clockwise; wherein the first rotation supporter rotates counter-clockwise as the second rotation supporter rotates counter-clockwise, and the main frame rotates clockwise;

a seat supporter, disposed within the chair seat, and connected to the first rotation supporter;

a restriction supporter, connecting between a base and the seat supporter; due to the seat supporter is restricted by the restriction supporter, the rotation angle is greater as the first rotation supporter rotates clockwise and the main frame rotates counter-clockwise; due to the seat supporter is restricted by the restriction supporter, the rotation angle is smaller as the first rotation supporter rotates counter-clockwise and the main frame rotates clockwise; and a driving module, connecting to the massage provider and the first electrical cylinder, driving the massage provider to provide massage service, and driving the first electrical cylinder to work.

2. The massage chair having curved track of claim 1, wherein the buttock section has an upward curve of radius within 110 mm to 210 mm; the leg section has a downward curve of radius within 90 mm to 270 mm.

3. The massage chair having curved track of claim 2, wherein the upward curve of the buttock section is connected to the downward curve of the leg section.

4. The massage chair having curved track of claim 1, wherein each internal slide track further includes a pinion placing surface and a pinion drive, the pinion drive is fixed on the pinion placing surface; moreover, the massage provider has a plurality of gearwheel rotating on the pinion drive.

5. The massage chair having curved track of claim 4, wherein each internal slide track further includes a sliding wheel accommodating slot; wherein the sliding wheel accommodating slot is connected by the pinion placing surface, and accommodates a plurality of sliding wheel of the massage provider; wherein the sliding wheel of the massage provider and gearwheel of the massage provider have the same rotation center.

6. The massage chair having curved track of claim 1, wherein the base disposed under the main frame; wherein the first rotation terminal of the first rotation supporter and the second rotation terminal of the second rotation supporter are both disposed on the base.

7. The massage chair having curved track of claim 6, wherein the restriction supporter has two side supporting frames and two side restricted frames; the main frame is flanked by the side supporting frames, and the side supporting frames are disposed on the base; the side restricted frames connects between the side supporting frames and the seat supporter.

8. The massage chair having curved track of claim 1, further comprising a foot massage device and a second electrical cylinder, both connecting to the driving module; wherein the foot massage device can provide massage service to foot; the foot massage device connects to the seat supporter, and the second electrical cylinder connects to the foot massage device; the foot massage device rotates relative to the seat supporter when the second electrical cylinder pushes the foot massage device.

9. The massage chair having curved track of claim 8, further comprising a cylinder supporter, connecting between the seat supporter and the second electrical cylinder.

* * * * *